US007845054B2

(12) United States Patent
Schmitz et al.

(10) Patent No.: US 7,845,054 B2
(45) Date of Patent: Dec. 7, 2010

(54) APPARATUS ON A COMBING MACHINE FOR MONITORING THE NOIL PERCENTAGE

(75) Inventors: Thomas Schmitz, Mönchengladbach (DE); Nicole Saeger, Aachen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 122 days.

(21) Appl. No.: 12/192,750

(22) Filed: Aug. 15, 2008

(65) Prior Publication Data

US 2009/0044382 A1 Feb. 19, 2009

(30) Foreign Application Priority Data

Aug. 17, 2007 (DE) ..... 10 2007 039 067

(51) Int. Cl.
*D01G 19/06* (2006.01)

(52) U.S. Cl. ..... 19/115 R; 19/65 A

(58) Field of Classification Search ..... 19/65 A, 19/115 R

See application file for complete search history.

(56) References Cited

U.S. PATENT DOCUMENTS

| | | | | |
|---|---|---|---|---|
| 5,404,619 | A * | 4/1995 | Jorg | 19/115 B |
| 5,421,190 | A | 6/1995 | Brandle et al. | |
| 5,457,851 | A | 10/1995 | Mondini | |
| 5,619,772 | A | 4/1997 | Leifeld | |
| 5,736,864 | A | 4/1998 | Moller | |
| 5,815,890 | A | 10/1998 | Leifeld | |
| 5,977,780 | A | 11/1999 | Herrmann | |
| 6,476,619 | B1 | 11/2002 | Moshe et al. | |
| 6,747,460 | B2 | 6/2004 | Moller et al. | |
| 6,837,122 | B2 | 1/2005 | Herrmann et al. | |
| 7,132,836 | B2 | 11/2006 | Peters et al. | |
| 2003/0150266 | A1 | 8/2003 | Dammig et al. | |
| 2006/0071670 | A1 | 4/2006 | Gohler et al. | |

FOREIGN PATENT DOCUMENTS

DE 1 213 767 3/1966

(Continued)

OTHER PUBLICATIONS

UK Search Report dated Nov. 21, 2008. Issued in connection with counterpart UK Application No. GB 0814901.5.

(Continued)

*Primary Examiner*—Shaun R Hurley
(74) *Attorney, Agent, or Firm*—Venable LLP; Robert Kinberg; Ryan M. Flandro

(57) ABSTRACT

In an apparatus on a combing machine for monitoring the noil percentage, having a supply device, a combing device for combing out fiber material to be combed and at least one device for forming a combed sliver, at least one arrangement is present for continuous automatic generation of a signal representing the noil percentage when the combing machine is running, the arrangement comprising at least one measuring device for the quantity of supplied fiber material and at least one measuring device for the quantity of combed fiber material and a calculating means for determining the noil percentage. For monitoring and optimization of the noil percentage, the or each measuring device for measuring the amount of combed fiber material may comprise a measuring device for a comber sliver having a feeler element or a contactless sensor.

26 Claims, 8 Drawing Sheets

FOREIGN PATENT DOCUMENTS

| | | | |
|---|---|---|---|
| DE | 195 37 983 | A1 | 4/1997 |
| DE | 102 04 328 | A1 | 6/2003 |
| DE | 103 34 144 | A1 | 1/2005 |
| DE | 10 2005 001 995 | A1 | 7/2006 |
| DE | 195 00 189 | B4 | 9/2006 |
| EP | 0 753 755 | A2 | 1/1997 |
| EP | 0 940 672 | A | 9/1999 |
| EP | 0 967 479 | A2 | 12/1999 |
| EP | 1 331 476 | A1 | 7/2003 |
| WO | WO 93/12277 | | 6/1993 |
| WO | WO 93/12278 | | 6/1993 |
| WO | WO-00/55606 | A2 | 9/2000 |
| WO | WO 2005/001176 | A1 | 1/2005 |

OTHER PUBLICATIONS

German Patent and Trademark Office Search Report, dated Nov. 4, 2008, issued in connection with counterpart German Application No. 10 2007 039 067.1.

* cited by examiner

APPARATUS ON A COMBING MACHINE FOR MONITORING THE NOIL PERCENTAGE

CROSS-REFERENCE TO RELATED APPLICATION

This application claims priority from German Patent Application No. 10 2007 039 067.1 dated 17 Aug. 2007, the entire disclosure of which is incorporated herein by reference.

BACKGROUND OF THE INVENTION

The invention relates to an apparatus on a combing machine for monitoring the noil percentage.

It is known to provide means for supplying and for combing out fibre material to be combed and means for forming at least one combed sliver, in which at least one arrangement is present for continuous automatic generation of a signal representing the noil percentage when the combing machine is running, the arrangement including at least one measuring device for the mass of supplied fibre material and at least one measuring device for the mass of combed fibre material and a calculating means for determining the noil percentage.

In the case of an apparatus according to WO 2005/001176 A, the noil percentage is determined indirectly, i.e. by measuring the quantity of fibre that runs into and out of a combing device. For that purpose, the combing device (combing head) is equipped with an arrangement device for determining the noil amount during operation, the arrangement comprising the following elements: for continuous determination of the incoming fibre amount (g/m), a thickness-measuring means and a sliver length-measuring means are associated with the intake rollers and delivery rollers respectively. The thickness-measuring means are displacement sensors, which measure the deflection of one roller of a pair of rollers and convert this deflection into electrical signals. A calibration in relation to the dependency of the amount of fibre (g/m) on the path deflection is effected. The sliver length-measuring means pick up the rotations of a roller and likewise generate electrical signals. In this apparatus the thickness of the incoming and outgoing fibre web is measured using feeler rollers. A drawback of this apparatus is the unsatisfactory measuring accuracy, since only the web thickness is measured and not the actual mass. Partial thick places in the webs falsify the measurement result. In addition, the web width is not constant, which is a prerequisite for a precise measurement. The calculated noil percentage for each of, for example, eight combing devices (combing heads), is output in the form of a table. The noil percentage (%) can also be represented in graph form over a period of time of, for example, 12 hours. Display of the noil percentages of the individual combing heads is effected in each case over relatively long periods of time. A correction of individual combs on the basis of the measurement results is possible only from time to time and only after the printouts or readouts, which reproduce a relatively long period of combing production, have been evaluated. There is no provision for a short-term fine adjustment. In practice, evaluations and, if applicable, adjustments, are regularly carried out by operational staff. It is also not possible to identify the reasons for undesirable variations from the readouts.

SUMMARY OF THE INVENTION

It is an aim of the invention to provide an apparatus of the kind described at the beginning which avoids or mitigates the mentioned disadvantages, and which in particular automatically monitors the combing device in such a way that the noil percentage can be determined and optimised even under different working conditions.

The invention provides an apparatus on a combing machine for monitoring the noil percentage, having:

a combing device for combing fibre material;

a supply device for supplying fibre material to the combing device; and a sliver-forming device for forming a sliver from the combed fibre material;

wherein the apparatus for monitoring the noil percentage comprises at least one measuring device for measuring the amount of supplied fibre material and at least one measuring device for measuring the amount of combed fibre material, the or each measuring device for measuring the amount of combed fibre material comprising a measuring device for a comber sliver, having a feeler element or a contactless sensor.

In a first aspect of the invention, a plurality of combing heads of a rectilinear combing machine are fed with wound laps. Comber slivers are delivered at the combing heads, and are combined to form a combed sliver, which leaves the combing machine. According to the first aspect of the invention, the incoming lap mass is weighed by a weighing machine, by which the actual incoming mass is directly determined. For measurement of the outgoing fibre sliver mass, a measuring device having a feeler element is used, for example, a web funnel with loaded feeler probe. This measuring device is structurally simple; the reduction in the number of moving parts to a minimum requires only a slight expenditure as regards drive mechanisms. Moreover, the low mass inertia of the feeler probe means that even short-wave fluctuations in the sliver mass can be detected. The quantity of lap supplied and/or the quantity of fibre sliver delivered can instead advantageously be determined by a measuring device with a contactless sensor, for example, a microwave sensor. The advantages of a contactless sensor are inter alia that no influence is exerted on the fibre mass during the measurement. Likewise, the fibre material exerts no influence on the sensor. In addition, none of the oscillation problems associated with mechanically moving parts occur. The contactless sensor is less susceptible to problems with the bulking up of a textile sliver. As there is no friction, energy efficiency is increased. In addition, as there are no moving parts, ease of maintenance is increased. Finally, it is the density that is measured, not the volume. The microwave sensor is also in principle able to measure the moisture content of the material.

In a second aspect of the invention, a plurality of combing heads of a rectilinear combing machine are fed with fibre slivers, for example, from sliver cans or from a canless store. Comber slivers are delivered at each of the combing heads, and are combined to form a combed sliver. According to the second aspect of the invention, both the incoming fibre slivers and the outgoing comber slivers are measured either by a measuring device having a feeler element, or by a contactless sensor. Both measuring systems can be used as alternatives, independently, both on the input side and on the output side. The advantages of the measuring devices having a feeler element or a contactless sensor are the same as or analogous to those already explained above for the first aspect of the invention.

In an especially preferred construction of the apparatus according to the invention, the arrangement for generating the signal representing the noil percentage is connected to a control and regulation device, which includes a device for comparison with predetermined values, and in the event of variations, electrical signals can be sent to an actuating and/or display device. In this way, the current noil percentage can successfully be determined online, and in a control unit, which may, for example, be the relevant electronic machine control, a check is carried out as a function of, for example, setpoint data, comparison and the operating situation, as to whether the noil percentage is moving within known and predetermined limits. In the event that corresponding variations are present, control signals are emitted to the combing device for correction. A particular advantage is that monitoring of the combing device is effected automatically. This monitoring is effected by means of software and can be carried out in the machine control (SPC—"Stored Program Control"). In particular, different working situations, special operating states and the like, and also defects, incorrect settings and the like can be accounted for. Using an arrangement according to the invention, it is possible inter alia to detect, for example, overloads, sluggishness and the like and to flag these up specifically or report them before more substantial damage occurs.

In one embodiment according to the first aspect of the invention, the supply device is arranged for supplying a fibre lap to the combing device and the measuring device for the amount of supplied material comprises a weighing device for determining the weight decrease of a lap roll. Advantageously, the lap mass is determinable at two consecutive points in time. Advantageously, the mass flow fed to the combing site is determinable by calculating a difference. Advantageously, the measured value for the mass flow is determinable using the diameter and the speed of rotation of the lap roll transport roller. Advantageously, the laps to be combed are drawn off the lap rolls. In some embodiments, the noil percentage is determinable using the difference in weights per unit of time (input to output). In some embodiments, the noil percentage is determinable using the difference in weights per length unit (input to output). Advantageously, the time at which the lap roll will run down to empty is determinable on the basis of the difference in the lap weight and the wood weight. In one embodiment, with different residual weights on the winding tubes and with individual drive of the combing heads, a simultaneous run-down to empty of the lap rolls can be facilitated by using different production speeds. Advantageously, the lap weight is determinable on the basis of the lap mass that enters within a specific unit of time. Advantageously, to determine the lap weight, the unwound length, for example, over the diameter, and the speed of rotation of the lap roll transport roller are used.

In accordance with the first aspect or the second aspect of the invention, there may be present, as a contactless sensor, a microwave sensor.

In certain preferred embodiments, the measuring device for a supplied fibre sliver and/or a comber sliver is a feeler element for determining the sliver thickness, for example, a spring-loaded delivery roller.

Advantageously, the measuring device for a supplied fibre sliver and/or a comber sliver is a sliver funnel with a feeler element. In one embodiment, the feeler element co-operates with a measured value transducer, for example, an inductive displacement sensor. In some embodiments, the combing machine comprises a plurality of combing heads, of which each comprises means for supplying a respective lap to be combed or a fibre sliver to be combed. In that case, the noil percentage may be determinable at each combing head. For example, a measuring device for a comber sliver may be present at the output of each combing head. In addition or instead, the noil percentage of the combing machine is determinable. For that purpose, a measuring device for a comber sliver may be present at the output of the combing machine. In one embodiment, in which the combing machine is a rectilinear combing machine having a drafting system without levelling, the combed sliver is measurable as output material. In another embodiment in which the combing machine has a drafting system with levelling, the signal is detectable upstream of the drafting system. In certain embodiments, for analysis of a single head, additional measuring devices are associated with the funnel for sliver combination. For example, for analysis of a single head, additional measuring devices may be associated with a calender roller pair downstream of the funnels for sliver combination.

Advantageously, a calibration of the measuring devices is effected. Advantageously, a system for determining the CV value is used for determining the output mass. In some embodiments, the combing machine is a rectilinear combing machine. In other embodiments, the combing machine is a rotor combing machine.

Advantageously, the monitoring is effected online. Advantageously, the unit of time is freely selectable. Advantageously, values for the difference in weights per unit of time are determinable at different time intervals. Advantageously, values for the difference in weights per unit of length are determinable at different time intervals.

Advantageously, the arrangement for generating the signal representing the noil percentage is connected to a control and regulation device, which includes a device for comparison with predetermined values, and in the event of variations electrical signals are arranged to be fed to an actuating and/or display device.

The invention further provides an apparatus on a combing machine for monitoring the noil percentage, having means for supplying and for combing out fibre material to be combed and means for forming at least one combed sliver, in which at least one arrangement is present for continuous automatic generation of a signal representing the noil percentage when the combing machine is running, the arrangement comprising at least one measuring device for the quantity of supplied fibre material and at least one measuring device for the quantity of combed fibre material and a calculating means for determining the noil percentage, characterized in that the means for measuring a supplied quantity of lap comprise weighing devices for determining the weight decrease of lap rolls, or a contactless sensor, and the means for measuring the quantity of combed fibre material contain a measuring device for a comber sliver having a feeler element or having a contactless sensor.

Moreover, the invention provides an apparatus on a combing machine for monitoring the noil percentage, having means for supplying and for combing out fibre material to be combed and means for forming at least one combed sliver, in which at least one arrangement is present for continuous automatic generation of a signal representing the noil percentage when the combing machine is running, the arrangement comprising at least one measuring device for the quantity of supplied fibre material and at least one measuring device for the quantity of combed fibre material and a calculating means for determining the noil percentage, characterized in that the means for measuring a supplied quantity of fibre sliver comprise a measuring device for a fibre sliver having a feeler element or having a contactless sensor, and the means for measuring the quantity of combed fibre material contain a measuring device for a comber sliver having a feeler element or having a contactless sensor.

DESCRIPTION OF CERTAIN PREFERRED EMBODIMENTS

Figure 1:
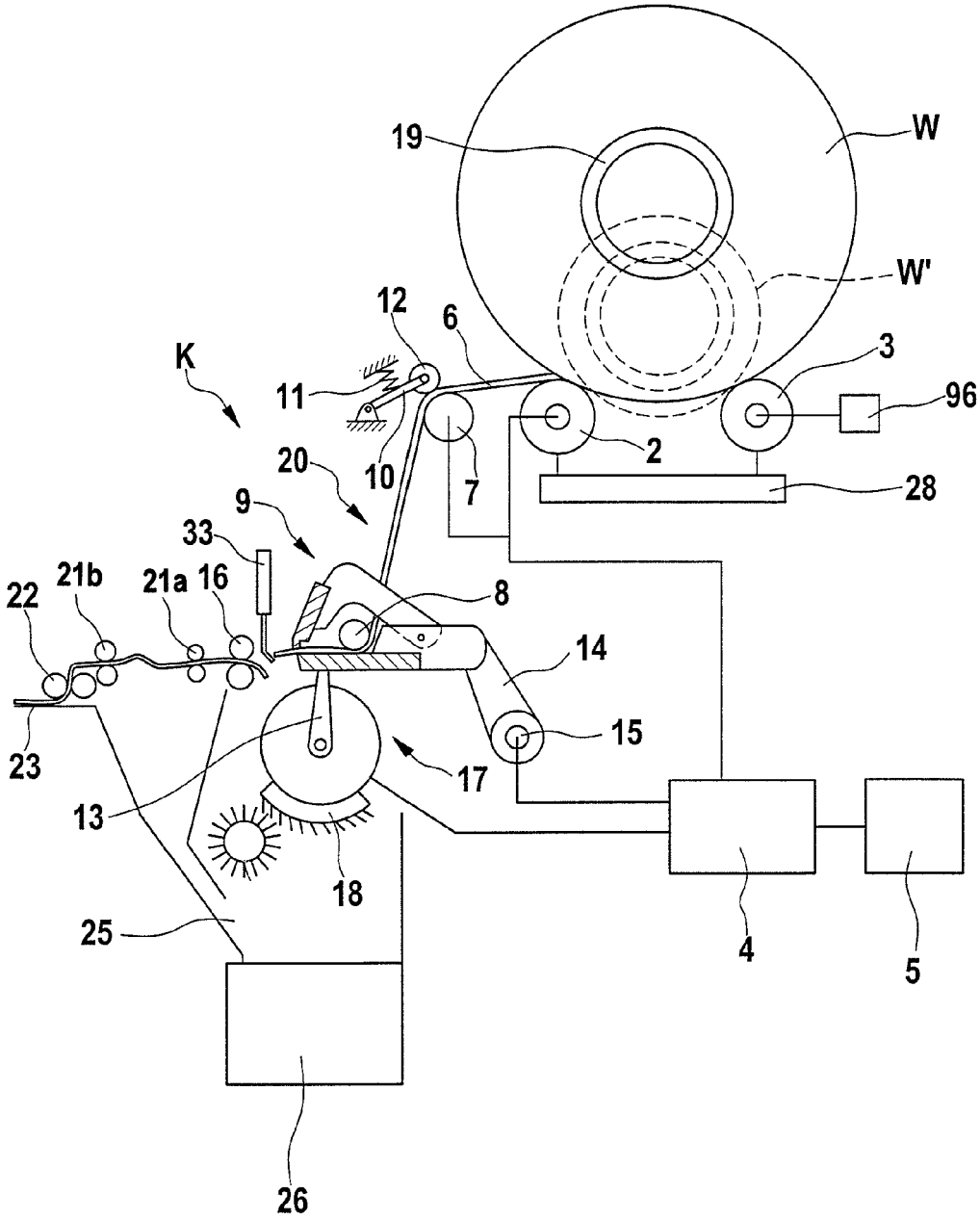
FIG. 1 is a diagrammatic side view of a combing head of a rectilinear combing machine with a weighing device for determining the weight reduction in a lap roll.

FIG. 1 shows a combing head K, of which a multiple of eight are mounted on a combing machine. For reasons of clarity, the exemplary embodiment is shown and described with reference to just one combing head, the features shown being installed on each of the combing heads, apart from the common drive units and the sliver deposition system. The combing head K consists of two lap roll rollers 2, 3, of which the front lap roll roller 2 is connected to a gear mechanism 4 that is driven via a motor 5. A lap roll W rests on the lap roll rollers 2, 3, and the lap 6 is unwound from the lap roll W by the rotary movement. The lap 6 undergoes a change of direction at a roller 7 and is transferred to a feed cylinder 8 of a nipper assembly 9. A pressure roller 12 mounted so as to pivot about a lever 10 under the bias of a spring 11 is arranged on the roller 7, which is here likewise driven by way of the gear mechanism 4. The nippers 9 are arranged to be driven via the levers 13, 14 in a reciprocating motion via a shaft 15, which is connected to the gear mechanism 4. According to the example illustrated, the nippers 9 are located in a forward position and transfer the combed-out fibre tuft to a downstream pair of detaching cylinders 16. Rotatably mounted beneath the nippers 9 is a circular comb 17, which uses its combing segment 18 to comb out the fibre tuft presented by the closed nippers. The circular comb 17 is likewise in drive connection with the gear mechanism 4. The lap 6 is wound on a tube 19. A ratchet wheel, not shown, is secured on the feed cylinder 8 and through the reciprocating motion of the nippers 9 is rotated stepwise by a pawl, also not shown, thereby feeding the lap 6 to the mouth of the nippers 9 for combing out. In operation, the lap 6 is continuously unwound over the lap roll roller 2 by the generated rotary movement of the lap roll W, and passes via the nip of the rollers 7 and 12 into the region 20 between the nip and the feed cylinder 8. The lap 6 is subsequently guided via the feed cylinder 8 to the mouth of the nippers 9 for combing out and is then delivered to the detaching cylinders 16. The resulting fibre fleece is combined via delivery roller pairs 21*a*, 21*b*, 22 and a delivery table 23 to a fibre sliver and fed with the fibre slivers likewise formed at the other combing heads to a drafting system 34 (cf. FIG. 3). The web emerging from the drafting system 34 is collected into a fibre sliver, called the comber sliver, and transferred to a sliver deposition arrangement for deposition into a can. During the combing process, the lap roll W of weight x decreases to the lap roll W', indicated by broken lines, of weight y. The dynamic changes developing on the strength of this decrease in weight, which have an effect in particular also on the retentive force exerted by the lap against unwinding, can have an effect only as far the clamping point. The dynamic changes in the region of the lap roll rollers 2, 3, in conjunction with the jerky dragging of the lap by the feed cylinder 8, do not have an adverse effect. On the contrary, in the region 20 the lap tension is constant and ensures that a lap of constant fibre mass is fed to the nipper assembly 9. The clamping force of the pressure roller 12 on the roller 7 is so great that the dynamic differences in the region of the lap roll rollers 2, 3 have no effect on the region 20. The combed individual combing head sliver then runs through the delivery roller pairs 21*a*, 21*b*, and 22 and is delivered by these in sliver form or web form onto the delivery table 23, which is associated with all combing heads of the machine jointly. The short fibres, neps and impurities removed from the fibre material by the circular comb 17 and a top comb 33 are extracted as what are called noils through a guide chute 25 into a suction channel 26, which is associated with all combing heads of the machine jointly. The individual combing head slivers from the different combing heads of the machine generally run side by side on the delivery table 23 to the common drafting system 34 (see FIG. 3). A sliver funnel 27 (see FIGS. 3-4), which forms the web into a comber sliver that is then deposited in a can 36 (see FIG. 3) is arranged at the output of the drafting system 34.

The arrangement for generating the signal representing the noil percentage contains means for measuring the quantity of lap supplied to the combing heads $K_1$ to $K_8$ of the combing machine per unit of time. The means for measuring the quantities of lap supplied per unit of time measure the quantities of lap per unit of time directly. The bearings of the lap roll rollers 2 and 3, which support the lap roll W in each combing head K, are supported by weighing scales 28, which emit a signal that represents the decrease in weight of the lap roll W per unit of time. The arrangement for generating the signal representing the noil percentage further contains a computer 93 (see FIG. 8). This calculates the noil percentage from the mass of the laps supplied per unit of time and the mass of the combed material formed per unit of time. The computer can calculate the mass of the laps supplied per unit of time from the scales 28 and from the supply speed of the lap 6. The computer 93 can calculate the mass of the combed material formed per unit of time from the thickness of the individual combing head slivers measured by the sliver funnel 27 and from the transport speed of the slivers.

Figure 2:
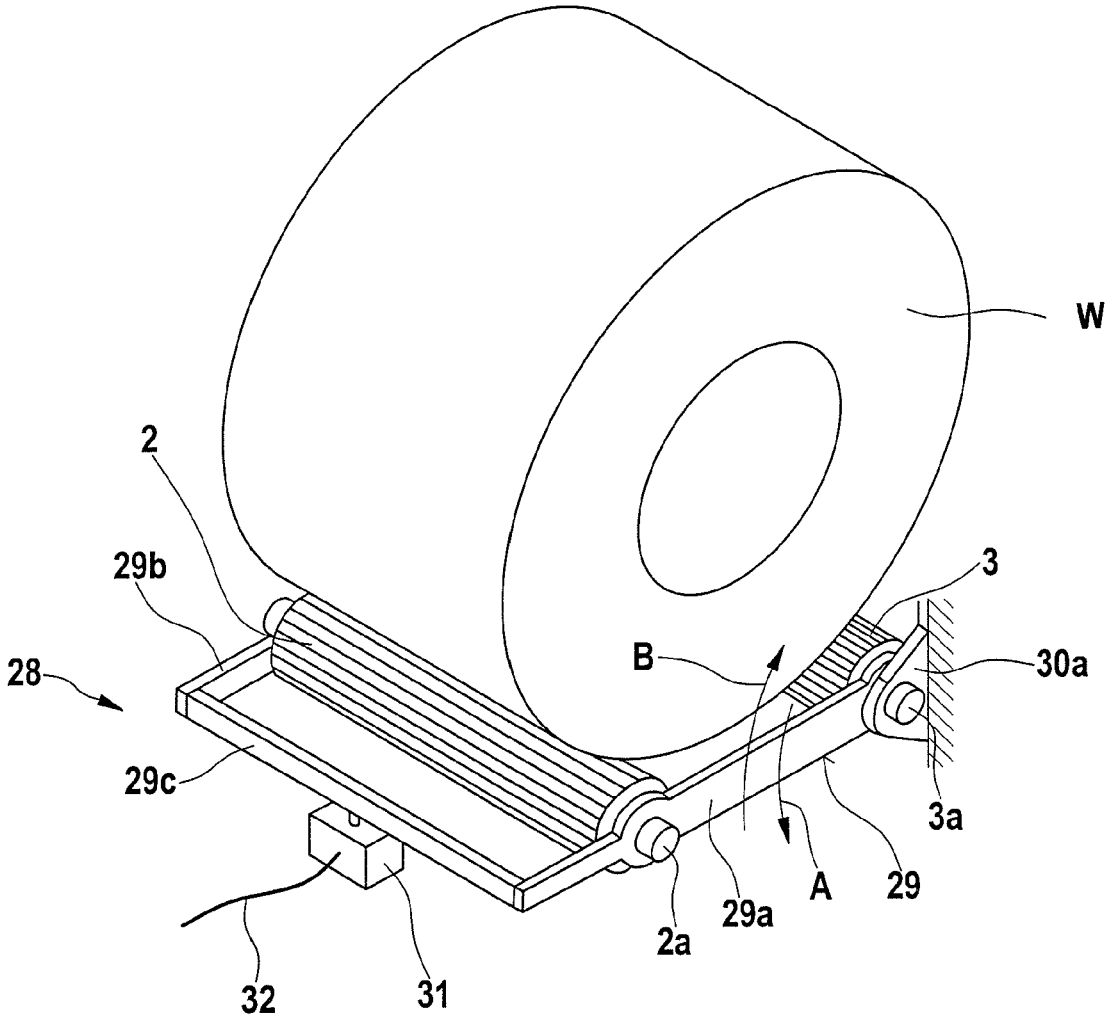
FIG. 2 is a perspective view of a lap roll with a weighing device with measuring element for the input mass.

In the case of a weighing system having weighing scales 28 according to FIG. 2, the two lap roll rollers 2, 3 arranged parallel to one another are arranged in a frame element 29 pivotally mounted at one side. The frame element 29 comprises two parallel side parts 29*a*, 29*b*, which are fixedly connected to one another at one end region by a crosspiece 29*c*. The other end regions of the side parts 29*a*, 29*b* are mounted in fixed-position pivot bearings 30*a*, 30*b* (only 30*a* is shown) so as to rotate in the direction of arrows A and B. The axle 2*a* of the lap roll roller 2 is mounted by its two ends in the side parts 29*a* and 29*b*. The axle 3*a* of the lap roll roller 3 passes through the side parts 29*a* and 29*b* and is mounted in the pivot bearings 30*a* and 30*b*. The crosspiece 29*c* lies on the upper side of a load cell 31, which converts the detected weight of the lap roll W into electrical pulses and feeds them via an electric cable 32 to the computer 93 (see FIG. 8).

Figure 3:
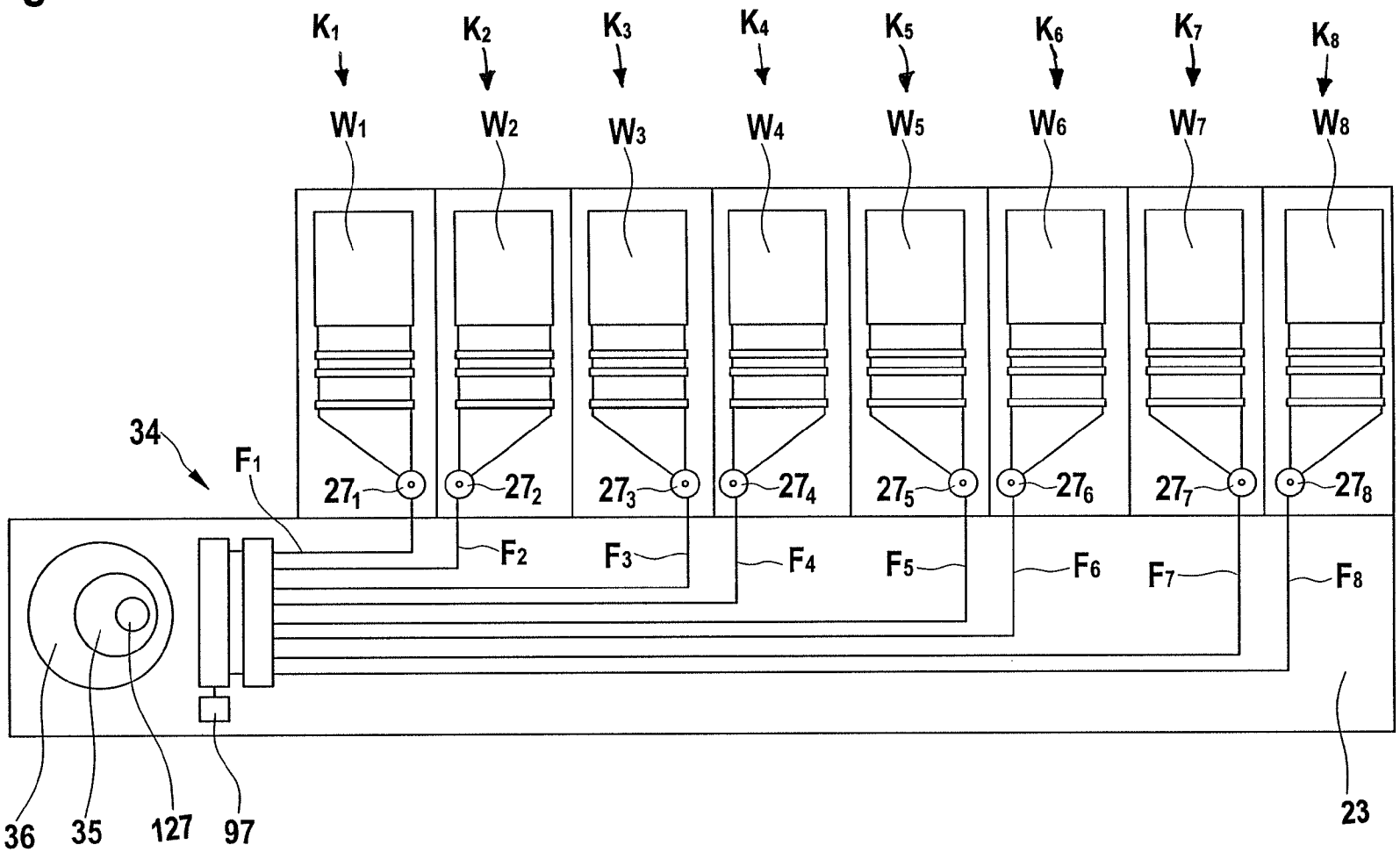
FIG. 3 is a diagrammatic plan view of a rectilinear combing machine, with eight combing heads for lap feed, having an apparatus according to the first aspect of the invention with measuring locations at each combing head for the input mass and output mass and a measuring site for the output mass of the machine.
Figure 4:
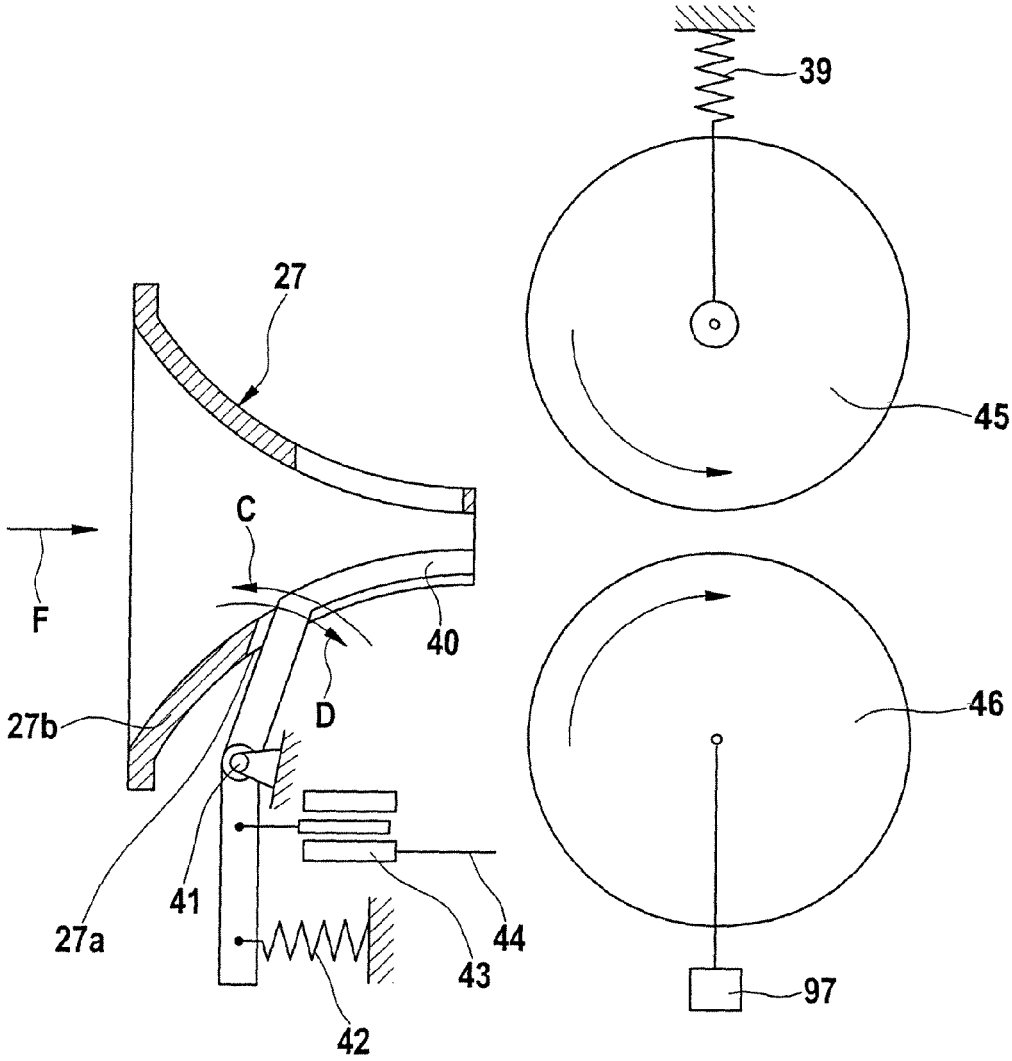
FIG. 4 is a side view of a sliver funnel with spring-loaded measuring probe and inductive displacement sensor.

In the embodiment of FIG. 3, in a rectilinear combing machine eight combing heads $K_1$ to $K_8$ are present, which are constructed, for example, corresponding to the form illustrated in FIG. 1. The combing heads $K_1$ to $K_8$ are each fed by a respective lap roll $W_1$ to $W_8$, each of which is allocated a scale $\mathbf{28}_1$ to $\mathbf{28}_8$ (see FIG. 1) for determining the input mass. Combed fibre material leaves each combing head $K_1$ to $K_8$ and is collected by a sliver funnel $\mathbf{27}_1$ to $\mathbf{27}_8$ to form a combed fibre sliver $F_1$ to $F_8$. The sliver funnels $\mathbf{27}_1$ to $\mathbf{27}_8$ are in the form of measuring funnels (for example, as described below with reference to FIG. 4), by which the output sliver mass at each combing head $K_1$ to $K_8$ is determined. The fibre slivers $F_1$ to $F_8$ arrive on the delivery table 23 and pass through a drafting system 34 to a sliver funnel 27, which combines all fibre slivers $F_1$ to $F_8$ to one fibre sliver F. The sliver funnel 27 is in the form of a measuring funnel (for example, as shown in FIG. 4), by which the output sliver mass at the combing machine is determined. The electrical signals of the sliver funnels $\mathbf{27}_1$ to $\mathbf{27}_8$ and 27 are supplied via electric cables to the computer 93 (see FIG. 8). The reference numeral 35 denotes a coiler head and the reference number 36 denotes a can. The reference numeral 97 denotes a sensor for the speed of the corresponding roller.

A sliver funnel 27 for use as measuring device for a combed sliver, or with suitable adaptation for use as measuring device for a supply sliver, in either of the first or second aspects of the invention is shown in FIG. 4. A feeler probe 40, which is mounted by way of a pivot bearing 41, loaded by a spring 42, and movable in the direction of the arrows C and D, engages through an opening 27*a* in the wall 27*b* of the sliver funnel 27. Associated with the feeler probe 40 is an inductive proximity initiator 43 (inductive displacement sensor), which converts the variations in thickness of the fibre sliver F into electrical signals, which are fed through an electric cable 44 to the computer 93 (see FIG. 8). The reference numerals 45 and 46 denote two co-operating delivery rollers. The delivery roller 45 is mounted so as to movable under the load of a spring 39. The deflection of the delivery roller 45 can be detected by an inductive displacement sensor (not shown). The circumferential speed of the roller 46 can be determined by the sensor 97, which may be connected to computer 93.

Figure 5:
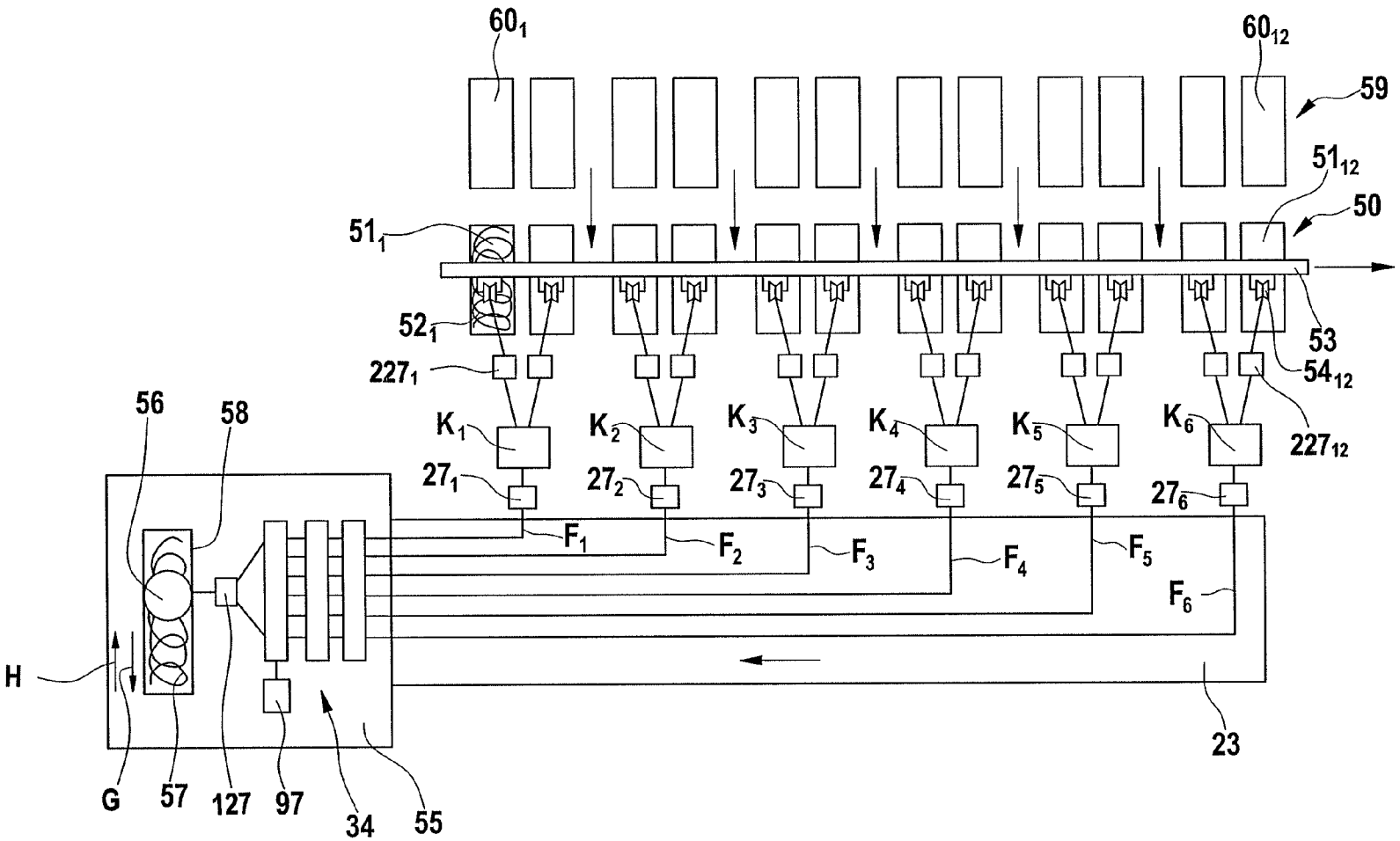
FIG. 5 is a plan view of a rectilinear combing machine having an apparatus according to the second aspect of the invention, with sliver feed.

In the embodiment of FIG. 5, a rectilinear combing machine with six combing heads $K_1$ to $K_6$ arranged side-by-side is present. Each combing head $K_1$ to $K_6$ is served by two supply cans $\mathbf{51}_1$ to $\mathbf{51}_{12}$ of substantially rectangular cross-section arranged side by side in a row 50, from which fibre slivers $\mathbf{52}_1$ to $\mathbf{52}_{12}$ deposited in coils (indicated in one can) are removed. For that purpose, a can frame 53 with guide rollers $\mathbf{54}_1$ to $\mathbf{54}_{12}$ extends above the supply cans $\mathbf{51}_1$ to $\mathbf{51}_{12}$; any delivery rollers present are not shown.

The fibre slivers $\mathbf{52}_1$ to $\mathbf{52}_{12}$ are combed in the combing heads $K_1$ to $K_6$ and guided over the sliver delivery table 23 to a drafting system 34, in which the fibre slivers $F_1$ to $F_6$ are drawn and subsequently collected by the sliver funnel 127 to produce a single fibre sliver. In the following sliver deposition arrangement 55, the fibre sliver 57 that has been produced is deposited in coils by a revolving plate 56 into a coiling can 58, in the form of a rectangular can, which traverses in the direction of the arrows G and H during sliver deposition. The coiling can 58 is transported from the supply can side to the filling position and after filling is removed to another machine for further processing of the fibre material. Behind the row 50 of supply cans $\mathbf{51}_1$ to $\mathbf{51}_{12}$ there is a row 59 of the same number of reserve cans $\mathbf{60}_1$ to $\mathbf{60}_{12}$.

The combing heads $K_1$ to $K_6$ are each fed by two fibre slivers $\mathbf{52}_1$ to $\mathbf{52}_{12}$, each fibre sliver $\mathbf{52}_1$ to $\mathbf{52}_{12}$ being allocated a respective sliver funnel $\mathbf{227}_1$ to $\mathbf{227}_{12}$ for determining the input mass. Combed fibre material leaves each combing head $K_1$ to $K_6$ and is collected by a respective sliver funnel $\mathbf{27}_1$ to $\mathbf{27}_6$ to form a combed fibre sliver $F_1$ to $F_6$. The sliver funnels $\mathbf{227}_1$ to $\mathbf{227}_{12}$ and $\mathbf{27}_1$ to $\mathbf{27}_6$ are in the form of measuring funnels (for example, as described with reference to FIG. 4), by which the input and output sliver mass respectively at each combing head $K_1$ to $K_6$ is determined. The fibre slivers $F_1$ to $F_6$ pass over the delivery table 23 and through the drafting system 34 to a sliver funnel 127, which collects all fibre slivers $F_1$ to $F_6$ to one fibre sliver F. The sliver funnel 27 is in the form of a measuring funnel (for example, as described with reference to FIG. 4), by which the output sliver mass at the combing machine is determined. The electrical signals of all the sliver funnels $\mathbf{227}_1$ to $\mathbf{227}_{12}$, $\mathbf{27}_1$ to $\mathbf{27}_6$ and 127 are supplied via electric cables to the computer 93 (see FIG. 8).

Figure 6:
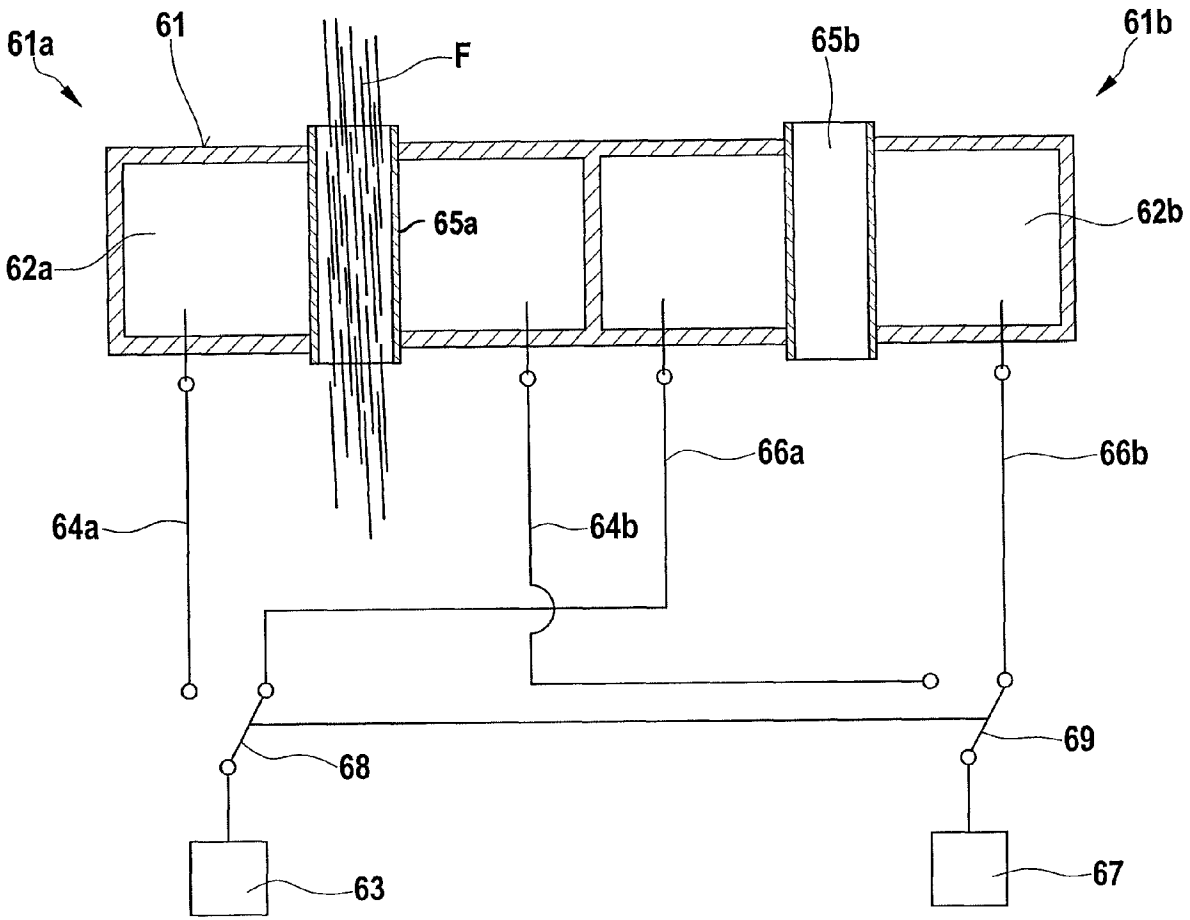
FIG. 6 is a cross-sectional view of a microwave measuring arrangement for measuring the input mass and/or output mass of the fibre material.

FIG. 6 shows a microwave measuring arrangement 61, for use as a measuring device with contactless sensor, for determining the input and/or output fibre mass. The microwave measuring arrangement has a measuring resonator 61*a* and the reference resonator 61*b* in a structurally integral measuring arrangement. The fibre sliver F is guided through two openings through the resonator chamber 62*a* of the measuring resonator 61*a*. Microwaves are generated by means of suitable devices 63 (microwave generator) and fed via a connection 64*a* into the resonator 61*a*. At a certain frequency, standing waves are excited in the resonator 61*a*. Microwaves enter the interior of the glass tube 65*a* and interact with the fibre sliver F located therein. The microwaves are extracted via a connection 64*b* and passed to a downstream evaluation device 67. The reference resonator 61*b*, including resonator chamber 62*b* and reference glass tube 65*b*, is arranged immediately adjacent to the measuring resonator 61*a*. Via connections 66*a*, 66*b* microwaves that have been branched off the microwave generator 63, preferably by means of the switch 68, are injected into and extracted from the reference resonator 61*b*. Via the switch 69, the microwaves are conducted to the evaluation unit 67. From the output signal the resonant frequency and the half-value width are determined, and from these the sliver mass is determined by means of the computer 93 (see FIG. 8).

Figure 7:
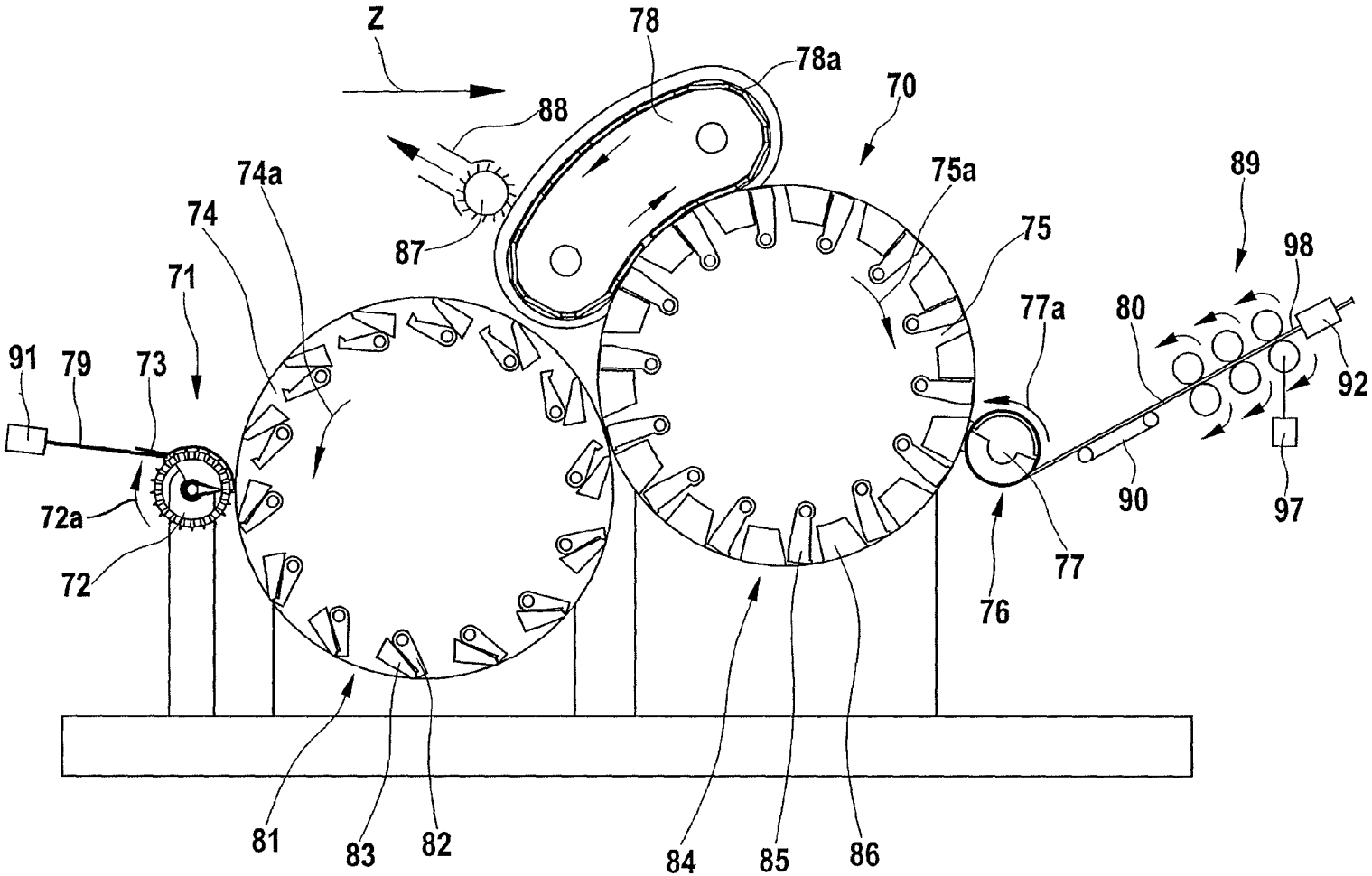
FIG. 7 is a diagrammatic side view of a rotor combing machine having two rollers and having a microwave measuring arrangement for measuring the input mass and output mass respectively.

FIG. 7 shows a further embodiment of the invention, in which the combing device is in the form of a rotor combing arrangement. The rotor combing machine 70 has a supply device 71 comprising a feed roller 72 and a feed tray 73, a first roller 74 (reversing rotor), second roller 75 (combing rotor), a take-off device 76 comprising a take-off roller 77, and a revolving flat combing assembly 78. The directions of rotation of the rollers 72, 74, 75 and 77 are shown by curved arrows 72*a*, 74*a*, 75*a*, and 77*a*, respectively. The incoming fibre lap is indicated by reference numeral 79, the delivered fibre web by reference numeral 80 and the delivered comber sliver by 98. The rollers 72, 74, 75 and 77 are arranged one after the other. Arrow Z denotes the operating direction. The first roller 74 is provided in the region of its outer periphery with a plurality of first clamping devices 81 which extend across the width of the roller 74 and each consist of an upper nipper 82 (gripping element) and a lower nipper 83 (counter-element). The second roller 75 is provided in the region of its outer periphery with a plurality of two-part clamping devices 84 which extend across the width of the roller 75 and each consist of an upper nipper 85 (gripping element) and a lower nipper 86 (counter-element). In the case of roller 75, around the roller periphery—viewed in the direction of rotation 75*a*—between the first roller 74 and the take-off roller (doffer) 77 the clamping devices 84 are closed; they clamp fibre bundles (not shown) at one end and the unclamped regions of the bundles are combed out by the combing elements 78*a* of the circulating revolving flat combing assembly 78. A cleaning roller 87 is furthermore associated with the combing elements 78*a*, which removes the combed-out noils from the combing elements 78*a*; these are then removed by a suction device 88. Reference numeral 89 denotes a drafting system, for example an autoleveller drafting system. The drafting system 89 is advantageously arranged above a coiler head (not shown). Reference numeral 90 denotes a driven ascending conveyor, for example a conveyor belt. It is also possible to use an upwardly inclined metal sheet or the like for conveying purposes. The rollers 74 and 75 are rollers rotating rapidly without interruption. A measuring element 91 for the input mass is associated with the incoming fibre lap 79, and a measuring element 92 for the output mass is associated with the delivered combed fibre sliver 98, both elements being connected to a computer 93 (see FIG. 8). Depending on the type of incoming fibre material and delivered combed fibre material (lap or, respectively, fibre sliver), the measuring elements 91 and 92 may be constructed as in any of FIG. 2, 4 or 6.

Figure 8:
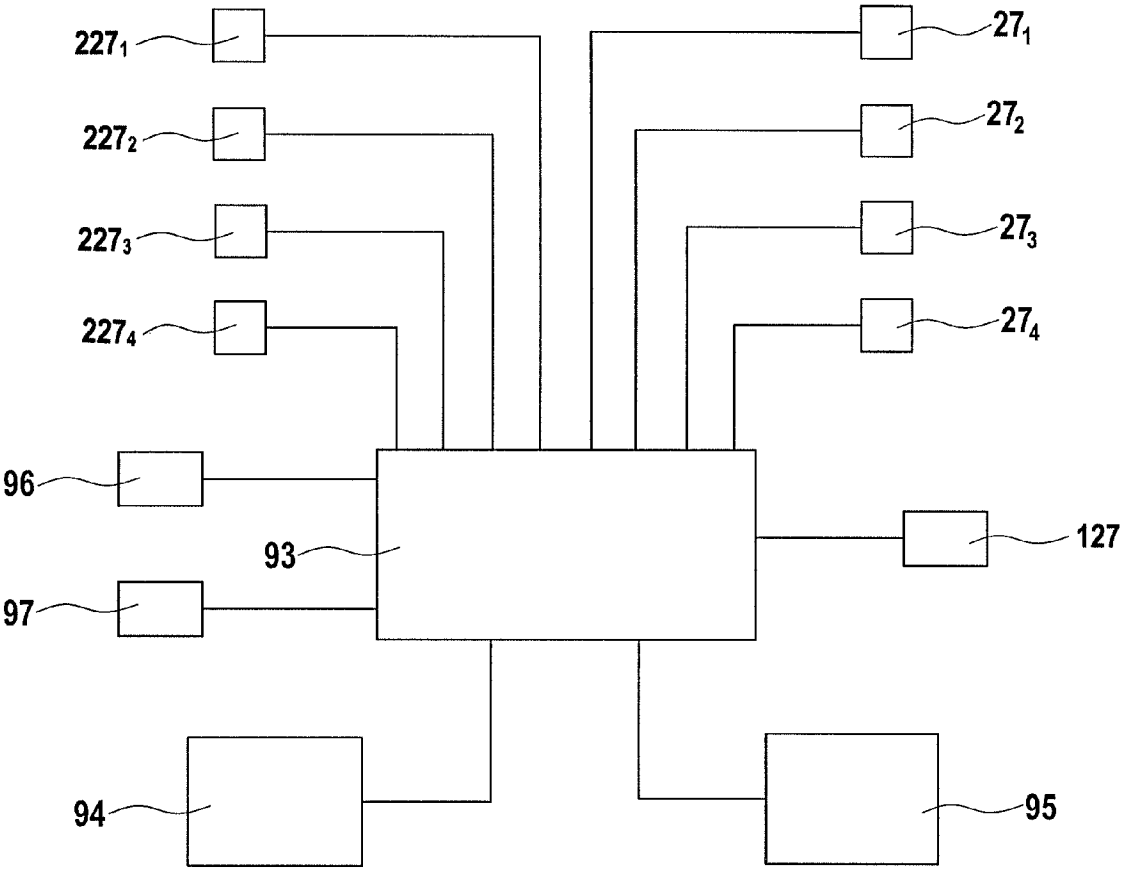
FIG. 8 is a block circuit diagram showing an electronic control and regulation device to which are connected measuring elements for measuring the input and output mass respectively at eight combing heads, a measuring element for the output mass of the machine, an actuator and a display device.

FIG. 8 shows an illustrative example of a control arrangement for an apparatus according to the invention. According to FIG. 8, an electronic control and regulation device 93, for example a microcomputer with a microprocessor, is provided, to which in the example illustrated are connected four measuring funnels $\mathbf{227}_1$ to $\mathbf{227}_4$ for the input mass at four combing heads $K_1$ to $K_4$, four measuring funnels $\mathbf{27}_1$ to $\mathbf{27}_4$ for the output mass at four combing heads $K_1$ to $K_4$, a measuring funnel 127 for the output mass at the combing machine, an actuating device 94 for adjustment or correction of machine elements at the combing heads $K_1$ to $K_4$, a display device 95, for example, a monitor or the like, a measuring element 96 for the rotational speed of a lap roll transport roller 3 (see FIG. 1) and a measuring element 97 for the sliver speed (delivery speed) of the combed fibre sliver. A measuring element for the sliver speed (not shown) may be present for each combed fibre sliver, i.e. not only at the input and/or at the output of each combing head but also at the output of the combing machine, and may be connected to the computer 93.

Settings on the combing machine that affect the noil percentage are in particular the detaching distance and the feed amount and feed point. For example, in the case of the rectilinear combing device of FIG. 1, the feed amount is the length by which the intermittently rotating feed cylinder 8 advances the lap during each reciprocating movement of the nippers 9. The feed point is the time point at which this advance takes place within each reciprocating movement of the nippers 9. The detaching distance is the distance of the lower clamping plate of the nippers 9 in their pushed-forward end position from the clamping line of the adjacent pair of detaching rollers 16. Gripping of the noils can be effected continuously or periodically directly at the individual combing heads of the combing machine. In this way a signal relating to the functioning of the individual combing heads is obtained and monitoring of the combing heads can thus be effected in comparison with the measured noil percentage at adjacent combing heads. The addition of these individual signals of the combing heads of a machine produces an overall signal that in turn can be used for the process control as a whole.

According to the invention the actual incoming mass can be determined. In the case of the first aspect of the invention, this is effected by measuring the wound lap mass at two consecutive points in time. Through subsequent difference formation, the mass flow (g/min) fed to the combing point is known. The measured value can also be expressed in g/m, i.e. in ktex, using the known diameter of the lap roll transport rollers 2, 3 and their rotational speed. The mass flow of the delivered combed sliver at the output of the combing machine is likewise determined. A measuring funnel 27 with feeler probe 40 (for example, as described with reference to FIG. 4) may be used for that purpose. The measuring funnel 27 can be calibrated a single time to the processed material by manually determining the weight per meter (a standard calibration on TC). The weight per meter can be converted into mass flow (g/min) using the known delivery speed. The noil percentage is then determined by computer (see example calculation). By additional measuring funnels 27 directly behind the combing heads, this principle may also be used for analysis of the individual heads.

The following is an illustrative example of a calculation of noil percentage in accordance with the invention:

Example Calculation:

Incoming mass flow per combing head: 150 g/min

Incoming mass flow at 8 combing heads: 8×150 g/min=1200 g/min

Delivered mass flow: 5 ktex at 200 m/min, hence 1000 g/min

Noil percentage: (1−1000/1200)×100%=16.7%.

Inter alia one or more of the following advantages may be achievable by the invention:

An online measurement enables inter alia the noil percentage p [%] to be determined, and the input weight and the combed sliver weight with respect to the combing machine as a whole and with respect to the individual combing heads to be monitored. This allows a process control and enables weak spots to be exposed, for example, enables incorrect settings and defective machine parts, such as the circular comb clothing, to be identified. The noil percentage can be adjusted in accordance with the material, and in the event of fluctuations in supply can be maintained at a constant level by varying the appropriate machine parameters. In this way, with waste amounts set at an optimum level, savings on raw material can consequently be achieved. An analysis of the combing process over a relatively long test period is rendered possible and the consistency among the individual combing heads can be determined. A statistical analysis of the data is possible. By additionally taking into account laboratory data, a correlation can be derived between supply data, combed sliver data and noil data and, for example, the noil percentage recorded on line.

One or more of the following further advantages may also be obtainable using an apparatus according to the invention:

- The noil percentage p [%] can be calculated using the difference in weights per unit of time (input to output). This is possible both for the machine as a whole and for the individual combing heads.
- The unit of time can be defined as desired and values can be determined at different time intervals.
- Variations between the combing heads can be detected.
- Possible variations between the combing heads can be altered manually or using a control and regulation program.
- There are many individual settings in the case of individual drives.
- Incorrect settings can be identified and corrected.

Defective parts, for example, circular comb clothings, can be identified, for example, owing to a change in the noil percentage p [%].

The noil percentage can be set according to the material, and in the event of fluctuations in supply can be maintained at a constant level by varying the appropriate machine parameters. In this way, by setting waste amounts at an optimum level, savings on raw material and improvements in quality can consequently be achieved.

A data acquisition and statistical analysis within a quality system is possible.

By additionally taking into account laboratory data, a correlation can be derived between supply data, combed sliver data and noil data and, for example, the noil percentage recorded online.

The measuring system for determining the output mass can be used in parallel with the CV value determination, or an existing system can be used to determine the CV value for determination of the output mass.

Determination of the mass at the output of the machine as a whole or at the individual heads permits sliver break and/or web break monitoring Hence monitoring, for example, at the web table could be omitted.

On the basis of the difference in lap roll weight to roll wood weight, the exact time at which the lap roll is running down to empty can be predicted. Systems in current use, for example, using the reflection of light beam, are no longer needed.

With different residual weights on the winding tubes and with individual drive of the combing heads, it is possible, for example, by employing different production speeds, to ensure that the lap rolls run down to empty simultaneously, and thus to implement a block change with automatic lap changeover.

The lap roll weight can be determined on the basis of the lap mass that enters in a specific unit of time. To do this, the unwound length is to be determined, for example, using the diameter and the speed of rotation of the lap roll transport roller. A quality control of the lap roll machine in respect of lap roll weight is thus possible.

Although the foregoing invention has been described in detail by way of illustration and example for purposes of understanding, it will be obvious that changes and modifications may be practiced within the scope of the appended claims.

The invention claimed is:

1. An apparatus on a combing machine for monitoring a noil percentage, having:

a combing device for combing fibre material;

a supply device for supplying fibre material to the combing device; and a sliver-forming device for forming a sliver from the combed fibre material;

wherein the apparatus for monitoring the noil percentage comprises at least one measuring device for measuring the amount of supplied fibre material and at least one measuring device for measuring the amount of combed fibre material, the or each measuring device for measuring the amount of combed fibre material comprising a measuring device for a comber sliver, having a feeler element or a contactless sensor.

2. The apparatus according to claim 1, wherein the supply device is arranged for supplying a fibre lap to the combing device, and wherein the measuring device for measuring the amount of supplied material comprises a weighing device for determining a weight decrease of a lap roll.

3. The apparatus according to claim 1, wherein the supply device is arranged for supplying a fibre lap to the combing device, and wherein the measuring device for measuring the amount of supplied fibre material comprises a contactless sensor.

4. The apparatus according to claim 2, wherein an actual incoming mass of the supplied fibre lap is determinable by the weighing device.

5. The apparatus according to claim 4, wherein the lap mass is determinable at two consecutive points in time.

6. The apparatus according to claim 4, wherein a measured value for the lap mass is determinable using a diameter and a speed of rotation of a lap roll transport roller.

7. The apparatus according to claim 2, further comprising a control device arranged to calculate, with different residual weights on a winding tube of each of a plurality of lap rolls, individual drive speeds of combing heads of the combing device for effecting a substantially simultaneous run-down to empty of the lap rolls.

8. The apparatus according to claim 1, wherein a lap weight is determinable on the basis of a lap mass that enters the combing device within a specific unit of time.

9. The apparatus according to claim 1, wherein an unwound length of the lap and a speed of rotation of a lap transport roller are used to determine a lap weight.

10. The apparatus according to claim 1, wherein the supply device is arranged for supplying a fibre lap to the combing device, and wherein the measuring device for measuring the amount of supplied fibre material comprises a feeler device or a contactless sensor.

11. The apparatus according to claim 10, wherein the feeler element is a spring-loaded delivery roller.

12. The apparatus according to claim 1, wherein the measuring device for measuring the amount of supplied fibre material is a sliver funnel with a feeler element, which cooperates with a measured value transducer.

13. The apparatus according to claim 1, wherein the measuring device for a comber sliver is a feeler element for determining a sliver thickness.

14. The apparatus according to claim 13, wherein the feeler element is a spring-loaded delivery roller.

15. The apparatus according to claim 13, wherein the measuring device for a comber sliver is a sliver funnel with a feeler element.

16. The apparatus according to claim 1, wherein the noil percentage is determinable using a difference in weights per unit of time of the supplied fibre material and the combed fibre material.

17. The apparatus according to claim 1, wherein the noil percentage is determinable using a difference in weights per length unit of the supplied fibre material and the combed fibre material.

18. The apparatus according to claim 1, wherein the contactless sensor comprises a microwave sensor.

19. The apparatus according to claim 1, wherein the combing machine comprises a plurality of the combing devices and a plurality of the supply devices, wherein each combing device includes a combing head, and wherein each supply device supplies a respective lap or sliver to be combed by the respective combing head.

20. The apparatus according to claim 19, wherein the noil percentage is determinable at each combing head, there being a measuring device for a comber sliver present at an output of each combing head.

21. The apparatus according to claim 20, further comprising another measuring device for a comber sliver at an output of the combing machine.

22. The apparatus according to claim 20, further comprising at least one funnel for combination of two or more comber slivers, wherein, for analysis of a single combing head, additional measuring devices are associated with each funnel for sliver combination.

23. The apparatus according to claim 22, wherein, for analysis of a single combing head, additional measuring devices are associated with a calender roller pair downstream of each funnel for sliver combination.

24. The apparatus according to claim 16, wherein values for the difference in weights per unit of time are determinable at different time intervals.

25. The apparatus according to claim 17, wherein values for the difference in weights per unit of length are determinable at different time intervals.

26. The apparatus according to claim 1, further comprising an arrangement for generating a signal representing the noil percentage, the arrangement being connected to a control and regulation device, which includes a device for comparison with predetermined values, the control and regulation device being arranged to effect a change in process or apparatus settings in dependence on the outcome of the comparison.

* * * * *